US006609932B2

(12) United States Patent
Fukatsu et al.

(10) Patent No.: US 6,609,932 B2
(45) Date of Patent: Aug. 26, 2003

(54) WATERTIGHT CONNECTOR AND A METHOD FOR MOUNTING IT

(75) Inventors: Yukihiro Fukatsu, Yokkaichi (JP); Toshikazu Sakurai, Yokkaichi (JP); Kiyofumi Ichida, Yokkaichi (JP); Hideshi Tachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/147,572

(22) Filed: May 15, 2002

(65) Prior Publication Data

US 2002/0177359 A1 Nov. 28, 2002

(30) Foreign Application Priority Data

May 18, 2001 (JP) ..... 2001-148700
Jul. 24, 2001 (JP) ..... 2001-222572

(51) Int. Cl.[7] ..... H01R 13/40
(52) U.S. Cl. ..... 439/588; 439/274; 439/352
(58) Field of Search ..... 439/587–589, 439/274, 345, 352; 429/275

(56) References Cited

U.S. PATENT DOCUMENTS 4,776,813 A 10/1988 Wilson et al.
4,900,271 A 2/1990 Colleran et al.
5,520,553 A 5/1996 Cecil, Jr. et al.
5,569,051 A * 10/1996 Endo et al. ..... 439/587
5,645,451 A * 7/1997 Ohsumi et al. ..... 439/587
5,941,737 A 8/1999 Sakai et al.
6,071,147 A * 6/2000 Tsukamoto ..... 439/587
6,217,394 B1 * 4/2001 Sugie ..... 439/752.5
6,250,962 B1 * 6/2001 Shinozaki ..... 439/587
6,254,428 B1 * 7/2001 Murakami et al. ..... 439/556

FOREIGN PATENT DOCUMENTS

JP 6-203902 6/1994

* cited by examiner

*Primary Examiner*—Tho D. Ta
*Assistant Examiner*—James R. Harvey
(74) *Attorney, Agent, or Firm*—Gerald E. Hespos; Anthony J. Casella

(57) ABSTRACT

A connector has a housing (20; 60) and a rubber plug (30; 70) mounted to the housing (20; 60). A plug holder (40; 80) can be held at a partial locking position on the housing (20; 60) where it is spaced back from the rubber plug (30; 70) and can be moved to a full locking position where it is located immediately behind the rubber plug (30; 70). The plug holder (40; 80) is dimensioned and configured to correct the orientation of the terminal fittings (10) when the plug holder (40; 80) is at the partial locking position. Thus, terminal fittings (10) can be inserted into the housing (20; 60) without damaging the rubber plug (30; 70).

12 Claims, 9 Drawing Sheets

WATERTIGHT CONNECTOR AND A METHOD FOR MOUNTING IT

BACKGROUND OF THE INVENTION

1. Field of the Invention

The invention relates to watertight connector and to a method for assembling the connector.

2. Description of the Related Art

A watertight connector is disclosed in Japanese Unexamined Patent Publication No. 6-203902 and is shown in FIG. 17 herein. The connector has a male housing 1 with cavities 2. A one-piece rubber plug 3 is provided at the rear side of the male housing 1 and is formed with wire insertion holes 4 at positions corresponding to the cavities 2. A plug holder 5 presses the rubber plug 3 forward and has terminal insertion openings 6 at positions corresponding to the wire insertion holes 4. Male terminal fittings 7 are fastened to ends of wires W and are inserted through the corresponding terminal insertion openings 6 of the plug holder 5. The terminal fittings 7 penetrate the rubber plug 3 by resiliently widening the wire insertion holes 4 and then advance into the cavities 2. The inner surfaces of the wire insertion holes 4 resiliently return toward their original shape after passage of the male terminal fittings 7 to achieve close sealing contact with the outer surfaces of the wires W.

The male terminal fitting 7 may be inserted obliquely, as shown at an upper stage of FIG. 17. Thus, a tab 8 at the leading end may strike against the inner surface of the wire insertion hole 4 of the rubber plug 3, and may deform or damage the rubber plug 3.

Damage to the rubber plug 3 could be avoided by thickening the plug holder 5 and elongating the terminal insertion openings 6. Thus, the orientation of the male terminal fitting 7 can be corrected while passing through the long terminal insertion opening 6, even if the male terminal fitting 7 initially is inserted obliquely. However, the thicker rubber plug holder 5 leads to a longer connector. This problem also is seen in male watertight connectors.

The present invention was developed in view of the above problem and an object thereof is to enable terminal fittings to be inserted in a proper orientation without enlarging a connector.

SUMMARY OF THE INVENTION

The invention is directed to a watertight connector with a housing that has at least one cavity. At least one terminal fitting is fastened to the end of a wire and is accommodated in the cavity. A sealing plug is mounted at a first surface of the connector housing and is formed with wire insertion holes at positions substantially corresponding to the respective cavities. The wire insertion holes are dimensioned to closely contact the outer surfaces of the wires. A plug holder is mounted on the housing and has terminal insertion openings at positions substantially corresponding to the wire insertion holes.

Thus, the terminal fittings are insertable through the terminal insertion openings. The plug holder can be held at a partial locking position where the plug holder is spaced from the sealing plug and at a full locking position where the plug holder presses the sealing plug. The terminal fittings are insertable toward the cavities through the terminal insertion openings when the plug holder is at the partial locking position. The plug holder may be moved to the full locking position after the terminals are inserted into the cavities.

The terminal fittings are inserted when the plug holder is at the partial locking position spaced back from the sealing plug. Thus, the leading ends of the terminal fittings are guided into the proper orientation by the inner surfaces of the terminal insertion opening before reaching the sealing plug, even if the terminal fittings are inserted obliquely into the terminal insertion openings. As a result, the leading ends of the terminal fittings will not collide with the inner surfaces of the wire insertion holes of the sealing plug, thereby preventing both deformation of the terminal fittings and damage to the rubber plug.

The rubber plug holder is pushed to the full locking position after the terminal fittings have been inserted. Thus, the connector can be compact and can have a small depth when in use.

The plug holder is at the partial locking position when the leading ends of the terminal fittings reach the entrances of the wire insertion holes of the sealing plug. Thus, the inclination of the terminal fittings is suppressed to or below an angle of inclination where the leading ends of the terminal fittings contact slanted guide surfaces at the entrances of the wire insertion holes.

The terminal fitting may remain inclined due to a fitting tolerance between the terminal fitting and the terminal insertion opening. However, the maximum inclination is suppressed sufficiently for the leading end of the terminal fitting to contact the guiding surface at the entrance of the wire insertion hole. Thus, even if an inclination remains, the terminal fitting is inserted into the wire insertion hole with an orientation corrected substantially to the proper orientation by the guiding surface and by the forwardly directed pushing forces on the terminal fitting.

A loose movement restricting means may be provided in the housing and/or on the plug holder. The loose movement restricting means restricts a loose movement of the plug holder in directions at an angle to an inserting direction of the terminal fittings, when the plug holder is at the partial locking position. Thus, the plug holder corrects the orientation of the terminal fittings more effectively.

The loose movement restricting means may comprise an engaging hole in the housing and an engaging pin that projects forward on the holder. Loose movement of the plug holder is restricted by the insertion of the engaging pin into the engaging hole when the plug holder is at the partial locking position.

The plug holder preferably is molded of a synthetic resin, and at least one thinning recess is formed by partly cutting away an area of the outer surface of the engaging pin that is inserted in the engaging hole when the plug holder is at the partial locking position. Thus, there is no possibility of deforming the engaging pin due to "sink marks" during the molding of the plug holder. Accordingly, undesirable shaking between the engaging pin and the engaging hole due to deformation of the engaging pin can be avoided, and the function of correcting the orientation of the terminal fittings will not be impaired.

The plug holder is molded by a mold that opens in a direction substantially parallel with a projecting direction of the engaging pin. Additionally, the thinning recess is a groove that extends oblique to the projecting direction of the engaging pin. Thus, the engaging pin is easily separable from the mold when the mold is opened in a direction parallel with the projecting direction of the engaging pin.

The plug holder preferably is molded of a synthetic resin, and a sealing surface is formed on an area of the outer surface of the engaging pin that closely contacts the inner surface of the insertion hole of the sealing plug when the plug holder is at the full locking position. Additionally, a thinning hole is formed by cutting away an inner portion of the engaging pin corresponding to the sealing surface. Thus, there is no possibility of deforming the engaging pin with "sink marks" created during the molding of the plug holder. Accordingly, adhesion between the sealing surface and the insertion hole of the rubber plug is not reduced due to the deformation of the engaging pin, and the sealing function is not impaired.

The invention also relates to a method for assembling a watertight connector. The method comprises providing a housing with at least one cavity for receiving a terminal fitting fastened to an end of a wire. The method also includes mounting a sealing plug at a first surface of the housing. The sealing plug is formed with at least one wire insertion hole substantially aligned with the cavity. The method then includes mounting a plug holder to the housing at a partial locking position spaced from the sealing plug. The plug holder has at least one terminal insertion opening aligned with the wire insertion hole. The method continues by inserting the terminal fitting through the terminal insertion opening and into the cavity, and then moving the plug holder to a full locking position pressed against the sealing plug.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
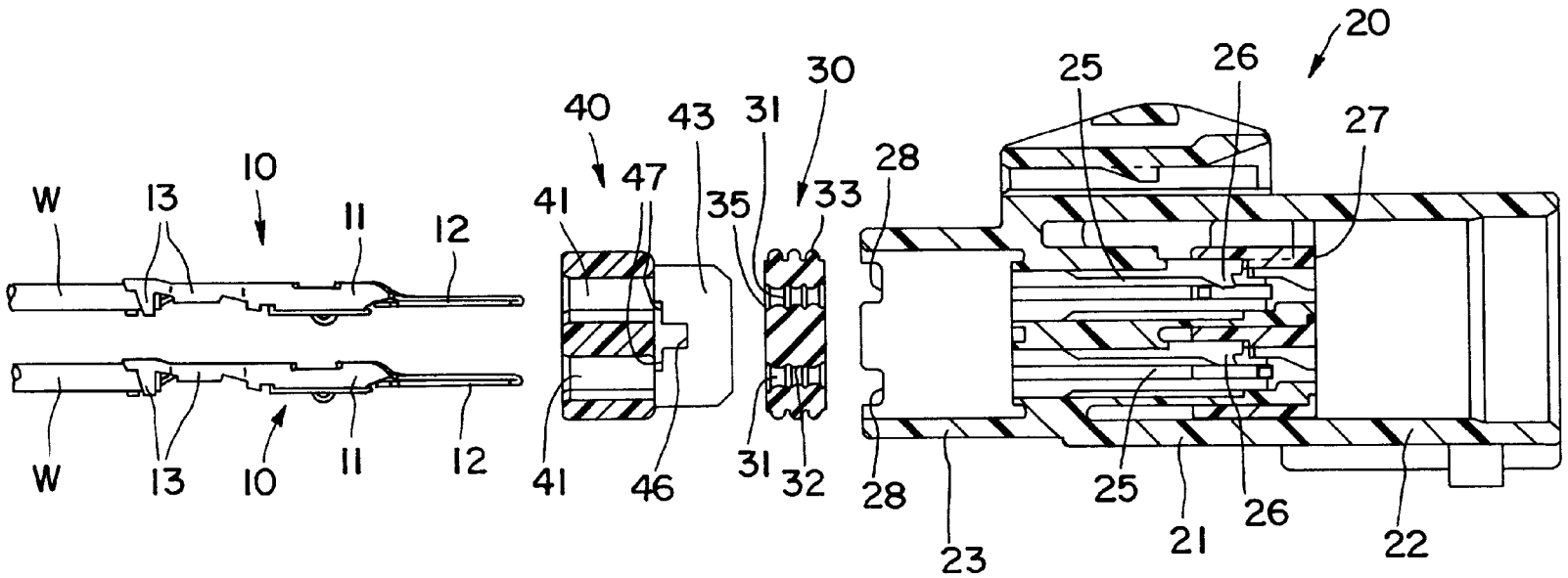
FIG. 1 is an exploded section of a connector according to a first embodiment of the present invention.

A one-piece male watertight connector in accordance with a first embodiment of the invention includes a male housing 20, male terminal fittings 10, a one-piece rubber plug 30 and a plug holder 40, as shown in FIG. 1. The right side in FIG. 1 is referred to as the front side in the following description, and is configured for mating with a female connector (not shown).

The male housing 20 is made e.g. of a synthetic resin and defines a substantially flat block shape with a main body 21. A forwardly open receptacle 22 is formed at the front of the main body 21 for receiving a mating female housing (not shown) and a rearwardly open mounting tube 23 is formed at the rear of the main body 21 for receiving the rubber plug 30 and the plug holder 40. Cavities 25 penetrate the main body 21 in forward and backward directions at two stages.

Each male terminal fitting 10 is formed by a press that stamps, cuts, bends, folds and/or embosses a metallic plate that has an excellent conductivity. The male terminal fitting 10 has a substantially tubular main body 11, a tab 12 that projects from the leading end of the main body 11, and barrels 13 at the rear end for crimped connection with an end of a wire W.

A lock 26 is formed in the ceiling wall of each cavity 25, and a front-type retainer 27 is mountable on the front surface of the main body 21 for restricting the deformation of the locks 26 by entering deformation permitting spaces for the locks 26 to doubly lock the male terminal fittings 10.

The one-piece rubber plug 30 is mounted at the back of the mounting tube 23 and defines a thick plate that substantially covers the rear of each cavity 25. The rubber plug 30 has wire insertion holes 31 at positions substantially corresponding to the respective cavities 25, and lips 32 are formed on the inner circumferential surface of each wire insertion hole 31 for close sealing contact with the outer surface of the wire W. Lips 33 are formed on the outer surface of the rubber plug 30 for close sealing contact with the inner surface of the back side of the mounting tube 23.

Figure 7:
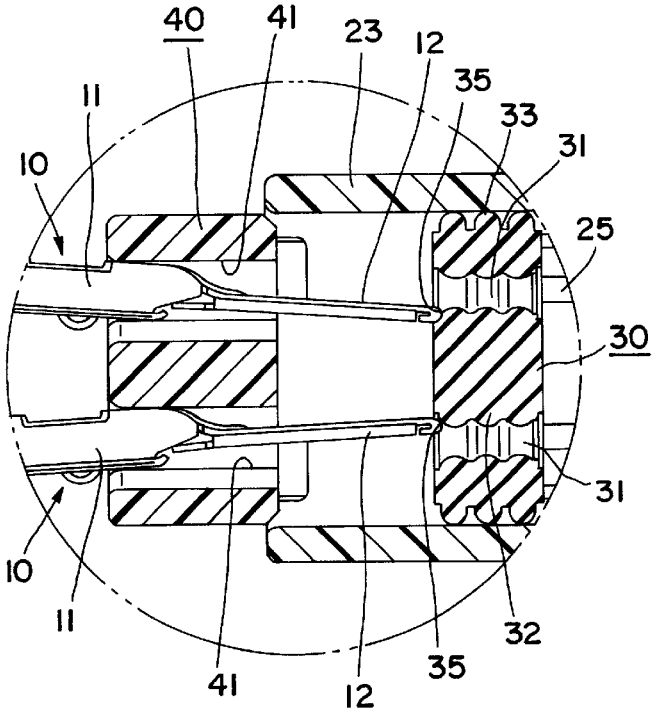
FIG. 7 is an enlarged fragmentary section showing the intermediate stage.

A guiding surface 35 is formed at an end of each wire insertion hole 31 and gradually tapers toward the inside, as shown in detail in FIG. 7. The guiding surfaces 35 guide the insertion of the male terminal fittings 10 into the wire insertion holes 31.

The plug holder 40 is made of a synthetic resin and defines a wide thick plate dimensioned to fit closely at the entrance side of the mounting tube 23 behind the rubber plug 30. Terminal insertion openings 41 extend through the plug holder 40 at positions substantially aligned with the cavities 25 and the wire insertion holes 31 for receiving the male terminal fittings 10. The plug holder 40 can be held at a partial locking position spaced back from the rubber plug 30 by a specified distance and at a full locking position immediately behind the rubber plug 30.

Figure 2:
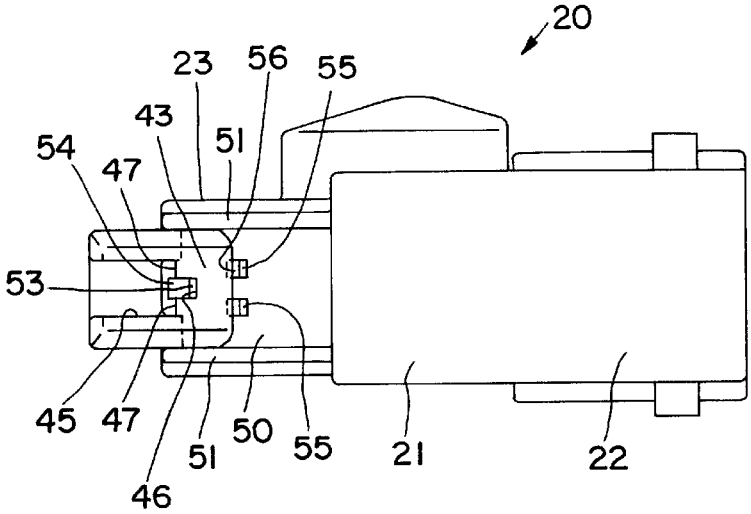
FIG. 2 is a side view showing a state where a plug holder is held at a partial locking position.
Figure 3:
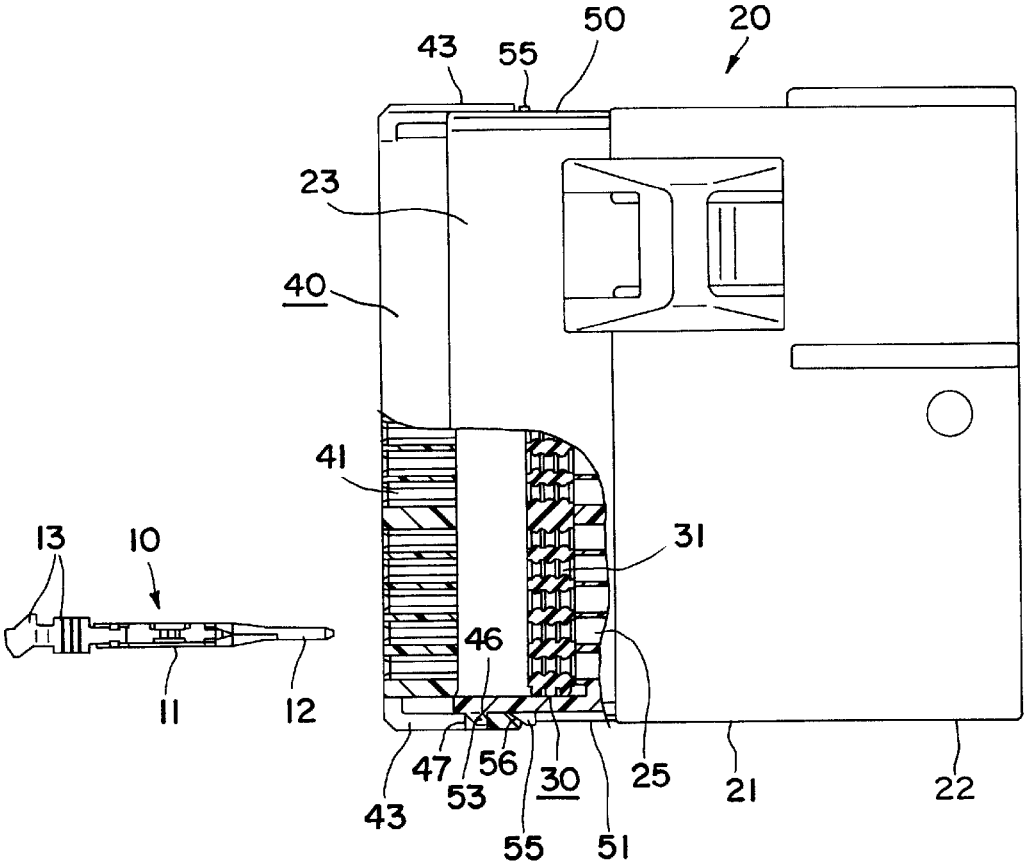
FIG. 3 is a plan view partly in section showing the state where the plug holder is held at the partial locking position.

Locking surfaces 50 are set on the outer left and right lateral surfaces of the mounting tube 23 of the male housing 20. On the other hand, locking plates 43 extend forward from the left and right lateral surfaces of the plug holder 40, as shown in FIGS. 2 and 3. The locking plates 43 are configured to slide on the locking surfaces 50. Upper and lower guide rails 51 are formed on each locking surface 50 for guiding a sliding movement of the locking plates 43 while holding the locking plates 43 between the guide rails 51.

A partial locking projection 53 is formed near the rear edge of each locking surface 50 and rear of each partial locking projection 55 defines a slanted surface 54 that slopes toward the front. Two full locking projections 55 are formed substantially in the middle of each locking surface 50 with respect to a depth direction, as shown in FIG. 2, and are spaced vertically apart by a specified distance. The rear of each full locking projection 55 defines a slanted surface 56 that slopes up toward the front.

A groove 45 of a specified width is formed in each locking plate 43 of the plug holder 40 and extends from its base edge substantially to a middle position with respect to the extending direction of the locking plate 43, and a narrow groove extends from a widthwise middle position of the front edge of the groove 45. The front edge of the narrow groove defines a partial locking edge 46 for engaging the partial locking projection 53 and the front edge of the groove 45 above and below the narrow groove defines full locking edges 47 for engaging the full locking projections 55.

The plug holder 40 can be mounted at the partial locking position in the mounting tube 23. In this position, the projecting edge of each locking plate 43 contacts the slanted surfaces 56 of the full locking projections 55, and the partial locking edge 46 engages the front surface of the partial locking projection 53, as shown in FIG. 2. At this partial locking position, the plug holder 40 projects out of the mounting tube 23, as shown in FIGS. 3 and 6.

The tabs 12 of the male terminal fittings 10 can pass through the terminal insertion openings 41 when the plug holder 40 is at the partial locking position. The plug holder 40 is dimensioned and disposed to ensure that the inclination of the male terminal fittings 10 is limited to or below a maximum angle of inclination where the leading ends of the tabs 12 could contact an area outside the guiding surfaces 35 at the entrances of the wire insertion holes 31 of the rubber plug 31 when and the leading ends of the tabs 12 reach the entrances of the wire insertion holes 31, as shown in FIG. 6.

Figure 6:
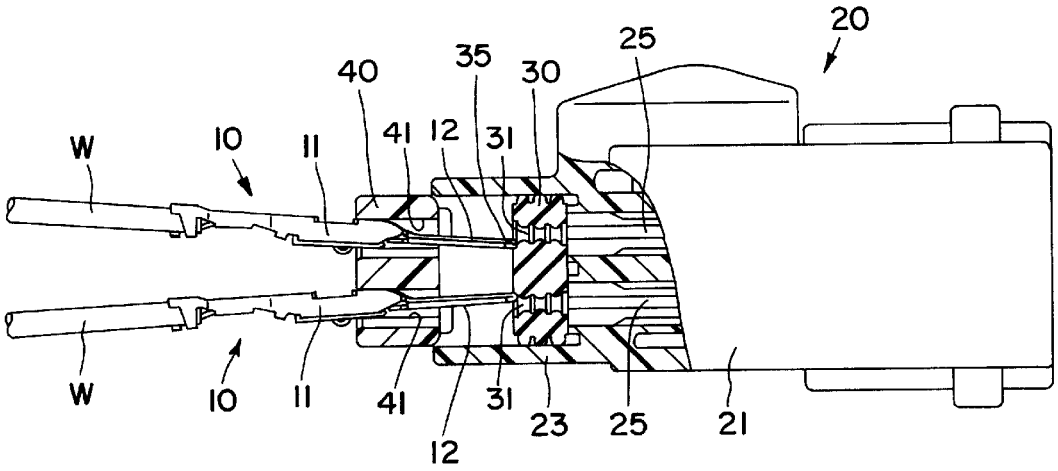
FIG. 6 is a side view partly in section showing an intermediate stage of insertion of male terminal fittings.

Depending on the shape of the leading end of the tubular main bodies 11 of the male terminal fittings 10, the maximum angle of inclination may differ when the male terminal fittings 10 are inclined down from the upper stage or up from the lower stage, as shown in FIG. 6. The male terminal fittings 10 have a larger maximum angle of inclination when inclined down, as shown at the upper stage of FIG. 6. Accordingly, as shown in FIG. 7, the connector is constructed such that the leading ends of the tabs 12 can still be brought into contact with the guiding surfaces 35 of the wire insertion holes 31 even if they are inclined down at the maximum angle of inclination.

Figure 4:
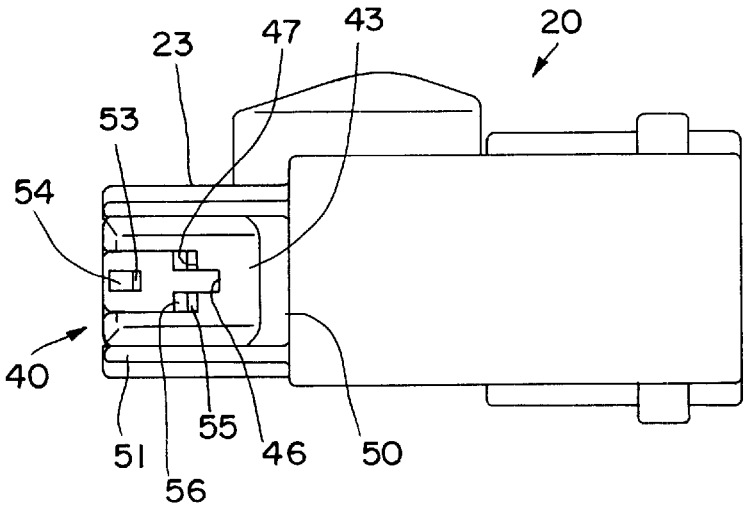
FIG. 4 is a side view showing a state where the plug holder is held at a full locking position.
Figure 5:
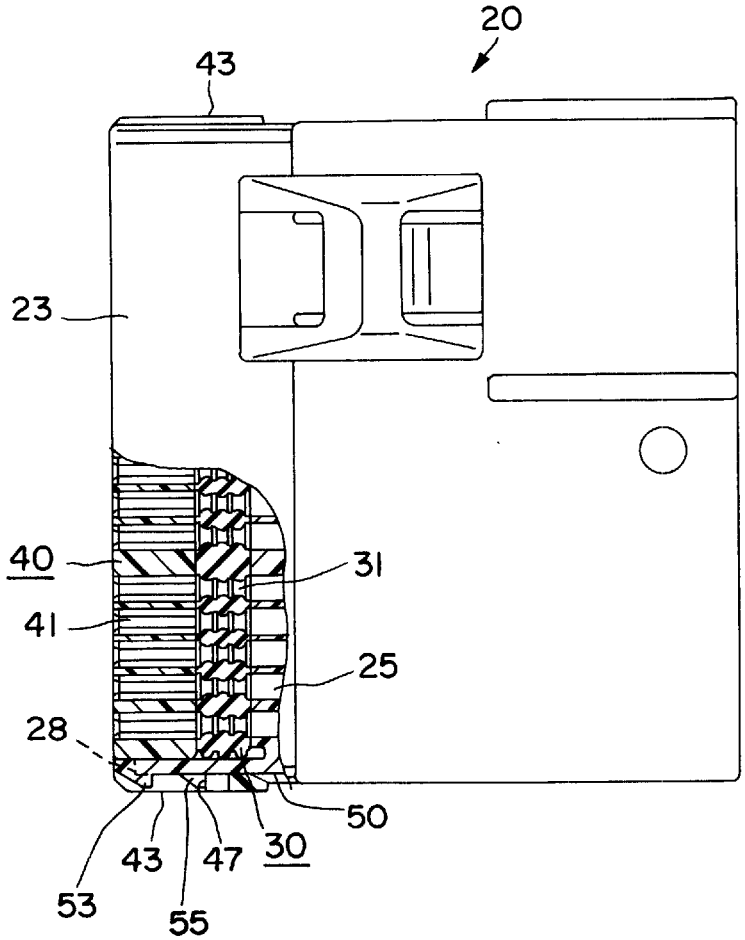
FIG. 5 is a plan view partly in section showing the state where the plug holder is held at the full locking position.

The plug holder 40 is pushed from the partial locking position to the full locking position so that the base ends of the locking plates 43 abut against abutting edges 28 at the left and right opening edges of the mounting tube 23, as shown in FIG. 5, and so that the full locking edges 47 engage the front surfaces of the full locking projections 55, as shown in FIG. 4. At the full locking position, the plug holder 40 is accommodated completely inside the entrance of the mounting tube 23 and is immediately behind the rubber plug 30.

The connector is assembled by sequentially mounting the rubber plug 30 and the plug holder 40 into the mounting tube 23. The plug holder 40 is pushed so that the projecting edges of the locking plates 43 fit between the corresponding pairs of guide rails 51 and move onto the slanted surfaces 54 of the partial locking projections 53. The slanted surfaces 54 cause the locking plates 43 to deform resiliently away from one another. However, sufficient pushing causes the partial locking edges 46 to pass the partial locking projections 53, and the locking plates 43 resiliently return toward their original positions, as shown in FIGS. 2 and 3. Thus, the projecting edges of the locking plates 43 contact the slanted surfaces 56 of the full locking projections 55 and the partial locking edges 46 engage the partial locking projections 53. In this way, the rubber plug holder 40 is held at the partial locking position and is spaced back from the rubber plug 30.

The male terminal fittings 10 fastened to the ends of the wires W then are inserted into the corresponding terminal insertion openings 41 of the plug holder 40. The male terminal fittings 10 could be inserted obliquely into the terminal insertion openings 41. However, the tubular main bodies 11 enter the terminal insertion openings 41 before the leading ends of the tabs 12 reach the rubber plug 30. Thus, the leading ends of the tabs 12 are guided by the inner surfaces of the terminal insertion openings 41 to correct the orientation of the tabs 12 into the proper horizontal orientation, and the tabs 12 are inserted properly into the wire insertion holes 31 of the rubber plug 30.

The male terminal fitting 10 may remain inclined due to a fitting tolerance between the male terminal fitting 10 and the terminal insertion opening 41. However, such an inclination is limited, and even at the maximum angle of inclination, the leading end of the tab 12 of the male terminal fitting 10 can be brought into contact with the guiding surface 35 at the entrance of the wire insertion hole 31. Thus, the male terminal fitting 10 can be guided into the proper horizontal orientation by the guiding surface 35 as the male terminal fitting 10 is pushed toward the wire insertion hole 31.

Figure 8:
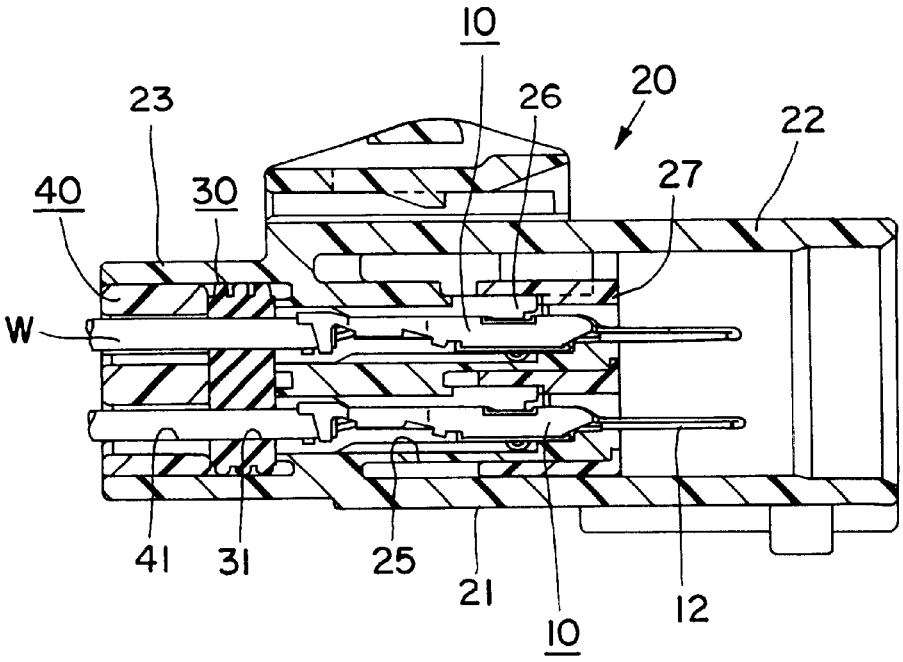
FIG. 8 is a longitudinal section of the connector when the insertion of the male terminal fittings is completed.
Figure 9:
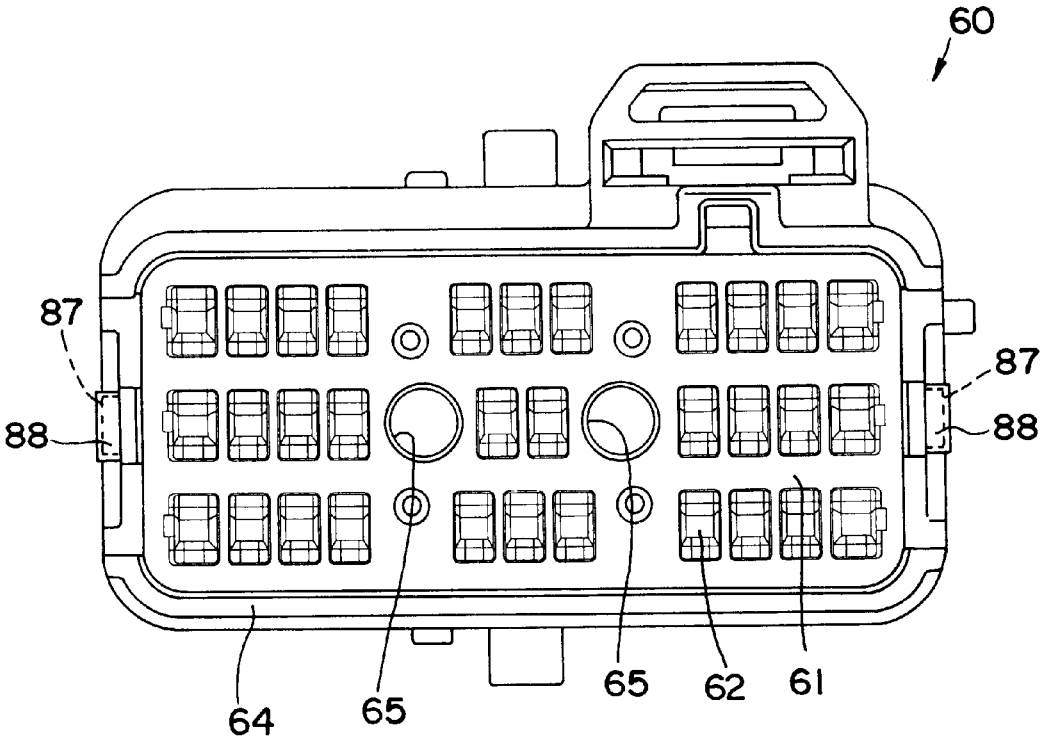
FIG. 9 is a rear view of a connector housing according to a second embodiment of the invention.

The male terminal fitting 10 is pushed further so that the tab 12 and the tubular main body 11 resiliently widen the wire insertion hole 31 and permit the male terminal fitting 10 to be inserted into the corresponding cavity 25. The lock 26 partly locks the male terminal fitting 10 when the male terminal fitting 10 reaches the proper position, as shown in FIG. 8. Further, the lips 32 on the inner surface of the wire insertion hole 31 are restored resiliently and are brought into close sealing contact with the outer surface of the wire W. The plug holder 40 is pushed again when all the male terminal fittings 10 have been inserted. Thus, the projecting edges of the locking plates 43 move onto the slanted surfaces 56 of the partial locking projections 55 and resiliently deform to widen the space between the locking plates 43. The plug holder 40 is pushed until the base ends of the locking plates 43 substantially abut against the abutting edges 28 of the mounting tube 23. Simultaneously, the full locking edges 47 pass the full locking projections 55 and are restored resiliently to engage the front surfaces of the full locking projections 55, as shown in FIG. 4. As a result, the plug holder 40 is held at the full locking position and is accommodated substantially completely in the mounting tube 23 immediately behind the rubber plug 30, as shown in FIG. 8.

Finally, the retainer 27 is mounted on the front of the main body 21 of the male housing 20 to lock the male terminal fittings 10 redundantly.

As described above, the male terminal fittings 10 are inserted with the plug holder 40 at the partial locking position spaced back from the rubber plug 30. The male terminal fittings 10 could be inserted obliquely into the terminal insertion openings 41. However, the angle of inclination is limited by the terminal insertion openings 41, and the leading ends of the tabs 12 are guided by the inner surfaces of the terminal insertion openings 41 before reaching the rubber plug 30 or the tabs 12 are guided by the guiding surfaces 35 of the insertion holes 31. As a result, the collision of the leading ends of the tabs 12 of the male terminal fittings 10 with the inner surfaces of the wire insertion holes 31 of the rubber plug 30 can be avoided to prevent both the deformation of the tabs 12 and the damage of the rubber plug 30.

The plug holder 40 is pushed to the full locking position completely in the mounting tube 23 when all of the male terminal fittings 10 have been inserted. Thus, the connector is compact in use.

The second embodiment is directed to a connector with means for restricting a loose movement of a plug holder 80 with respect to a connector housing 60. Since the other main constructions are same as in the first embodiment, the structures, functions and effects of the same or similar constructions are not described or only briefly described. In the following description, right side in FIGS. 12 to 15 is referred to as the front.

The connector housing 60 has a main body 61 formed with cavities 62 and a receptacle 63 that projects forward from the main body 61. A rearwardly open mounting tube 64 is formed at the rear of the main body 61 for mounting a one-piece rubber plug 70 and a plug holder 80. Engaging holes 65 extend longitudinally between the front end surface of the main body 61 and the back end surface of the mounting tube 64. The engaging holes 65 have a round cross section, and extend parallel to the moving direction of the plug holder 80 between a partial locking position and a full locking position. Left and right engaging holes 65 are provided at middle positions with respect to the height direction of the connector housing 60.

The rubber plug 70 has round insertion holes 72 that correspond substantially coaxially to the engaging holes 65 of the connector housing 60 and wire insertion holes (not shown) that substantially correspond to the cavities 62. Circumferential lips 72L are formed on the inner surfaces of the insertion holes 72.

Figure 14:
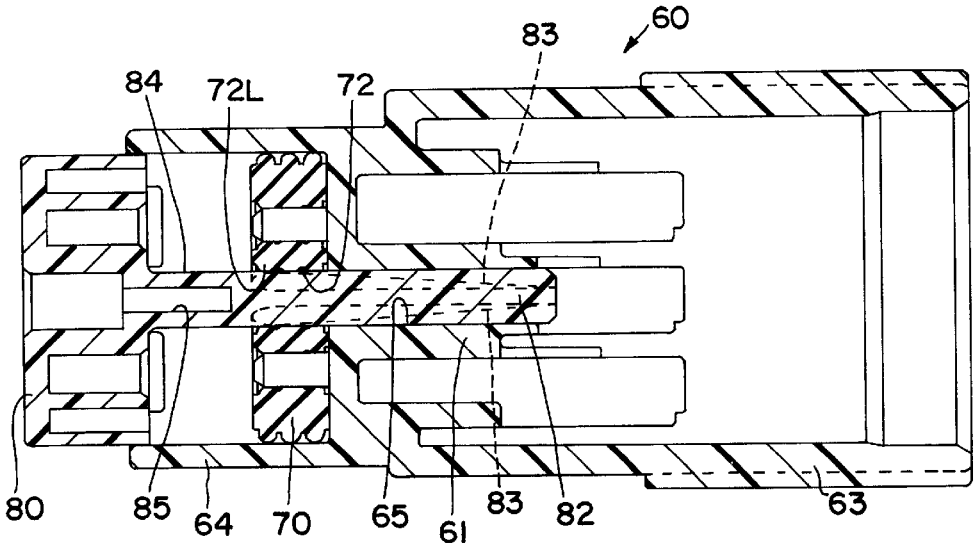
FIG. 14 is a section showing a state where the plug holder is held at a partial locking position.
Figure 15:
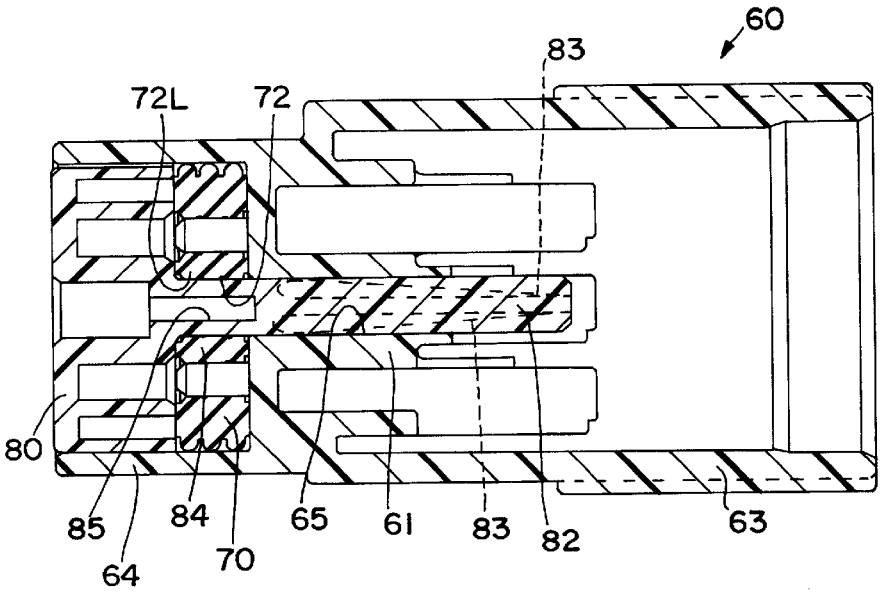
FIG. 15 is a section showing a state where the plug holder is held at a full locking position.
Figure 16:
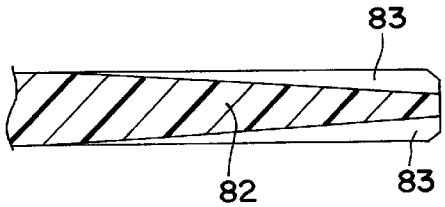
FIG. 16 is a fragmentary section showing the shape of thinning recesses of an engaging pin of the plug holder.
Figure 17:
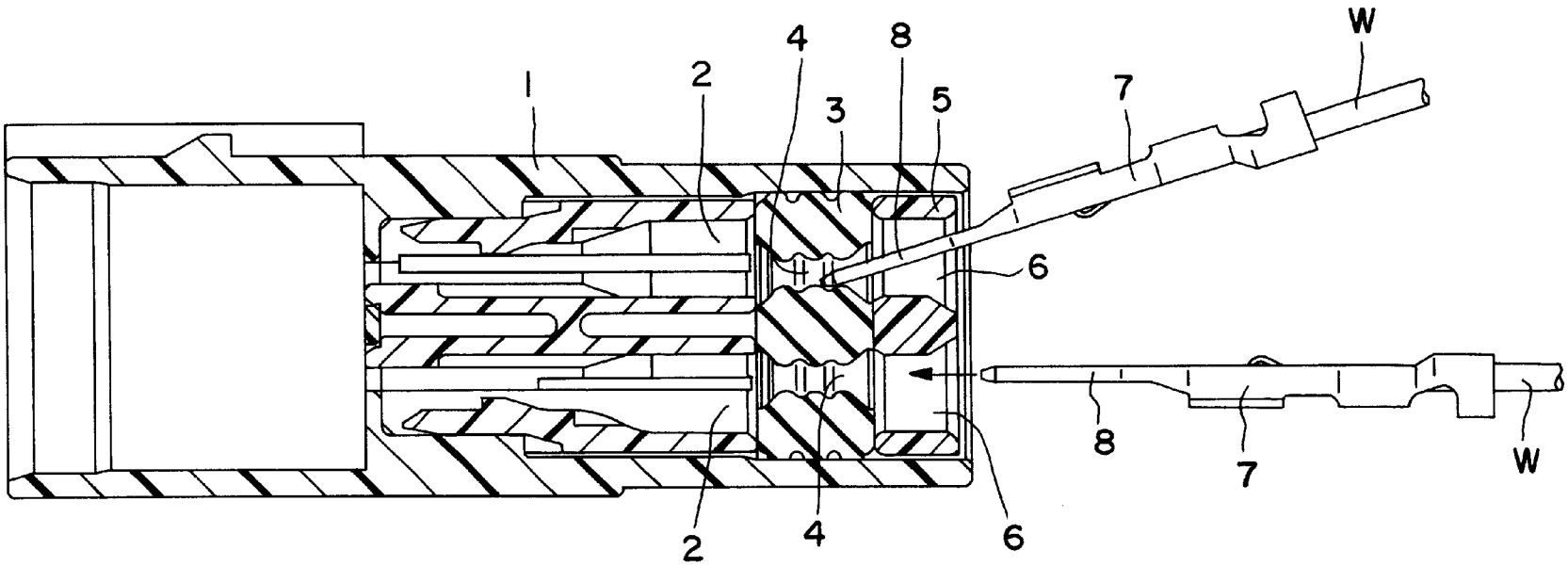
FIG. 17 PRIOR ART
FIG. 17 is a section of a prior art connector.

The plug holder 80 has terminal insertion openings 81 and cross sectional round engaging pins 82 that project from the front surface of the plug holder 80. The engaging pins 82 correspond substantially coaxially to the engaging holes 65 and the insertion holes 72. The outer diameter of the engaging pins 82 is larger than the inner diameter of the lips 72L of the insertion holes 72 of the rubber plug 70 and is substantially equal to the inner diameter of the engaging holes 65 of the connector housing 60. A projecting distance of the engaging pins 82 from the plug holder 80 is set such that the engaging pins 82 fit in the engaging holes 65 over their entire areas and project slightly forward from the front surface of the main body 61 when the plug holder 80 is at the partial locking position, as shown in FIG. 14.

Figure 10:
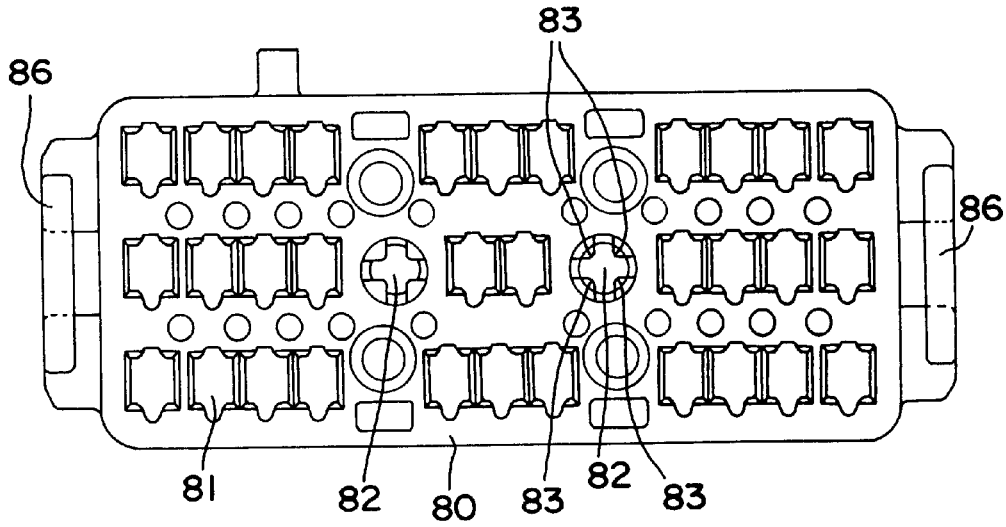
FIG. 10 is a front view of a plug holder.
Figure 11:
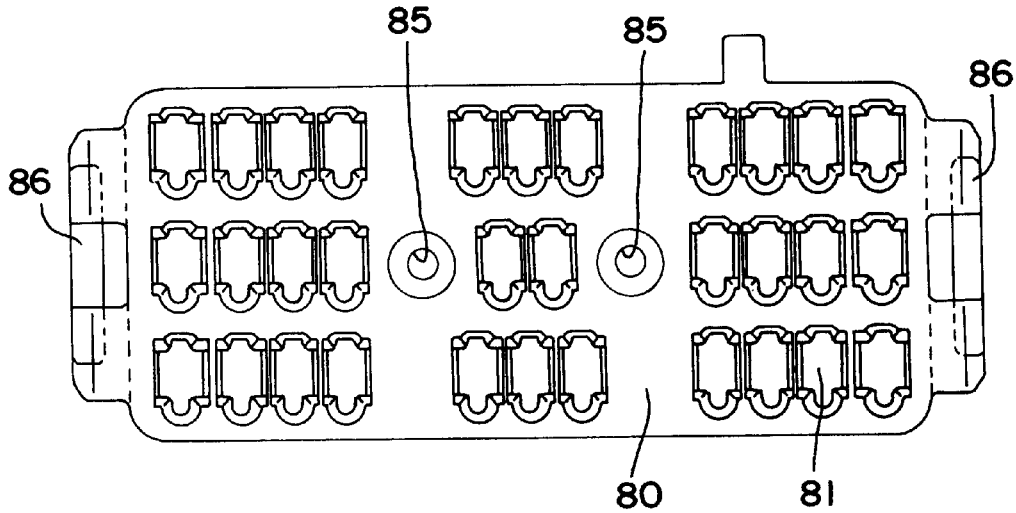
FIG. 11 is a rear view of the plug holder.
Figure 12:
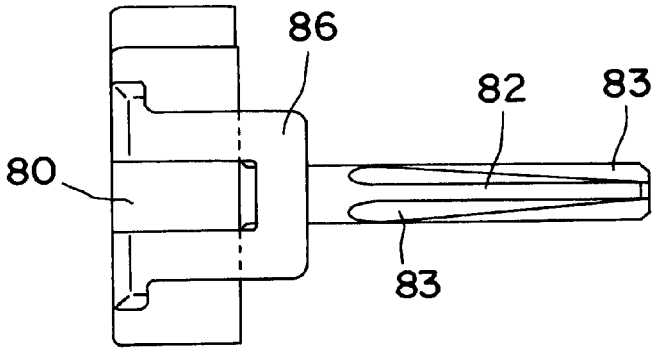
FIG. 12 is a side view of the plug holder.
Figure 13:
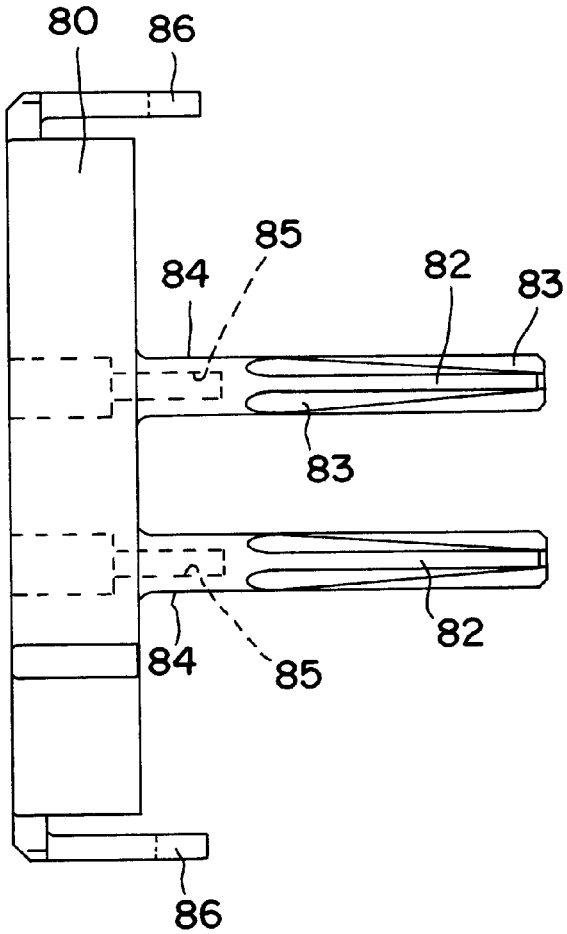
FIG. 13 is a plan view of the rubber plug holder.

The plug holder 80 is molded e.g. of a synthetic resin and has four elongate thinning recesses 83 at evenly circumferentially spaced positions on each engaging pin 82, as shown in FIG. 10. The thinning recesses 83 are formed in part of the outer surface of each engaging pin 82 that is in the corresponding engaging hole 65 when the plug holder 80 is at the partial locking position. The mold for molding the symmetrical plug holder 80 is openable in a direction parallel with the projecting direction of the engaging pins 82. As a result, the thinning recesses 83 define oblique grooves that gradually narrow toward the projecting end of the engaging pin 82. Thus, the engaging pins 82 are easily separable from the mold when the mold is opened.

An outer circumferential surface 84 of each engaging pin 82 is brought into close sealing contact with the lips 72L on the inner circumferential surface of the corresponding insertion hole 72 of the rubber plug 70 when the plug holder 80 is at the full locking position. A thinning hole 85 is formed inside each engaging pin 82 by cutting a portion corresponding to the sealing surface 84 to have a round cross section coaxial with the sealing surface 84. The thinning holes 85 are open at the rear end of the plug holder 80.

The rubber plug 70 and the plug holder 80 are mounted sequentially into the mounting tube 64 of the housing 60. As a result, the engaging pins 82 move through the insertion holes 72 of the rubber plug 70 and into the engaging holes 65 of the connector housings 60 to hold the rubber plug 70 stably with respect to the housing 60. Thus, the plug holder 80 is held at the partial locking position (see FIG. 14) where it is spaced back from the rubber plug 70 by a means similar to that of the first embodiment. The plug holder 80 is held by a construction for engaging locking plates 86 with full locking projections 87 and partial locking projections 88, as in the first embodiment.

The engaging pins 82 of the rubber plug holder 80 are in the engaging holes 65 of the connector housing 60 when the plug holder 80 is at the partial locking position. Thus, loose movement of the rubber plug holder 80 is restricted with respect to the connector housing 60 in directions at an angle to an inserting direction of terminal fittings (not shown). The orientation and position of the plug holder 80 enable the plug holder 80 to correct the orientation of the terminal fittings with high reliability.

The area of the outer surface of each engaging pin 82 that is in the corresponding engaging hole 65 when the plug holder 80 is at the partial locking position is partly cut away to form the thinning recesses 83. Thus, there is no possibility of deforming the engaging pins 82 due to "sink marks" created during the molding of the plug holder 80. Accordingly, shaking between the engaging pins 82 and the engaging holes 65 due to deformation of the engaging pins 82 is avoided, and there is no resulting impairment of the ability of the plug holder 80 to correct the orientation of the terminal fittings.

The male terminal fittings 10 are inserted into the cavities 62 when the plug holder 80 is at the partial locking position. The plug holder 80 then is pushed to the full locking position (see FIG. 15) and engages the rear surface of the rubber plug 70 to prevent the rubber plug 70 from coming out. Additionally, the plug holder 80 is accommodated completely in the mounting tube 64 by a means similar to that of the first embodiment, i.e. a construction for engaging the locking plates 86 with the full locking projections 87.

The sealing surfaces 84 of the engaging pins 82 are held in close resilient contact with the lips 72L of the insertion holes 72 of the rubber plug 70 while the rubber plug holder 80 is at the full locking position. Thus, water and other fluid does not enter from outside through the insertion holes 72. Further, the thinning holes 85 are formed in regions of the engaging pins 82 aligned with the sealing surfaces 84. Thus, the engaging pins 82 are not deformed by "sink marks" during the molding. Accordingly, adhesion between the sealing surfaces 84 and the insertion holes 72 of the rubber plug 70 is not diminished due to the deformation of the engaging pins 82 and sealing is not impaired.

The invention is not limited to the above described and illustrated embodiments. For example, following embodiments also are embraced by the technical scope of the invention as defined in the claims. Beside the following embodiments, various changes can be made without departing from the scope and spirit of the present invention as defined in the claims.

The invention is also applicable to female watertight connectors.

Sections of the guide rails 51 and the locking plates 43 that are in sliding contact may be elongated by moving the full locking projections 55 forward (right in FIG. 2) and extending the front ends (right ends) of the locking plates 43 forward to restrict loose movement of the plug holder in the housing.

The invention was described with reference to a one-piece rubber plug. However, the invention is applicable to other types of sealing plugs, such as multiple-piece rubber plugs, sealing plugs made of a resilient material other than rubber, etc.

What is claimed is:

1. A watertight connector, comprising:

a housing with a main body having opposite front and rear surfaces and a plurality of cavities extending therebetween and into which male terminal fittings fastened to ends of wires can be accommodated, each said male terminal fitting having a substantially tubular main body and a tab projecting forward from the tubular main body for a specified length, the tabs being cross-sectionally smaller than the tubular main bodies, a sealing plug with opposite front and rear surfaces, the front surface of the sealing plug being mounted at the rear surface of the main body of the housing, wire insertion holes extending between the front and rear surfaces of the sealing plug and being substantially aligned with the respective cavities, the wire insertion holes being dimensioned for close sealing contact with the wires, a plug holder mounted to the housing and formed with opposite front and rear surfaces and terminal insertion openings substantially aligned with the wire insertion holes, the terminal insertion openings being dimensioned for insertion of the tubular main bodies of the terminal fittings, wherein the plug holder is moveable between a partial locking position where the rear surface of the plug holder is spaced from the rear surface of the sealing plug by a distance greater than the specified length of the tabs of the terminal fittings, and a full locking position where the front surface of the plug holder presses the rear surface of the sealing plug, the terminal insertion openings being configured for guiding the tubular main bodies of the terminal fittings such that the tabs are oriented for insertion into the wire insertion holes of the sealing plug when the plug holder is at the partial locking position.

2. The watertight connector of claim 1, wherein the plug holder is holdable at the full locking position after the terminal fittings are inserted into the cavities.

3. The watertight connector of claim 1, wherein the sealing plug is a one-piece rubber plug.

4. The watertight connector of claim 1, wherein the terminal insertion openings of the plug holder are dimensioned to limit inclination of the terminal fittings to or below a maximum angle of inclination for preventing the terminal fittings from contacting the sealing plug outside slanted guide surfaces at the entrances of the wire insertion holes.

5. The watertight connector of claim 1, further comprising loose movement restricting means on the housing and the plug holder for restricting loose movement of the plug holder at the partial locking position in directions at an angle to an inserting direction of the terminal fittings.

6. The watertight connector of claim 5, wherein the loose movement restricting means comprises an engaging hole in the housing and an insertion hole in the sealing plug, an engaging pin being formed on the plug holder and projecting toward the housing, wherein loose movement of the plug holder is restricted by insertion of the engaging pin through the insertion hole and into the engaging hole when the sealing plug holder is at the partial locking position.

7. The watertight connector of claim 6, wherein the plug holder is molded of a synthetic resin, and at least one thinning recess being formed on outer surface areas of the engaging pin.

8. A watertight connector, comprising:

a housing with an engaging hole and at least one cavity into which at least one terminal fitting fastened to ends of a wire can be accommodated, a sealing plug mounted at a first surface of the housing and formed with a pin insertion hole aligned with the engaging hole and at least one wire insertion hole substantially aligned with the respective cavity, the wire insertion hole being dimensioned for close sealing contact with the wire, and a plug holder mounted to the housing and formed with at least one terminal insertion opening substantially aligned with the wire insertion hole, the terminal insertion opening being dimensioned for insertion of the terminal fitting, the plug holder being moveable between a partial locking position where the plug holder is spaced from the sealing plug and a full locking position where the plug holder presses the sealing plug, the terminal fitting being insertable toward the cavity through the terminal insertion opening when the plug holder is at the partial locking position, an engaging pin being formed on the plug holder and projecting toward the housing, the plug holder being molded of a synthetic resin and at least one thinning recess being formed on an outer surface of the engaging pin, the plug holder being symmetrical about a plane passing through a projecting direction of the engaging pin, and the thinning recess being a groove extending oblique to the projecting direction of the engaging pin, wherein loose movement of the plug holder is restricted by insertion of the engaging pin through the pin insertion hole and into the engaging hole when the sealing plug holder is at the partial locking position.

9. The watertight connector of claim 8, wherein a sealing surface is formed on an area of the engaging pin that closely contacts the insertion hole of the sealing plug when the plug holder is at the full locking position, and a thinning hole being formed on an inner portion of the engaging pin substantially opposed to the sealing surface.

10. A watertight connector, comprising a housing with a main body having opposite front and rear ends and a plurality of cavities extending between the ends, a receptacle projecting forwardly beyond the front end of the main body and a mounting tube projecting rearwardly beyond the rear end of the main body, the cavities being dimensioned to accommodate male terminal fittings therein such that tabs of the male terminal fittings project beyond the main body and into the receptacle, resiliently deflectable locks being formed in the main body for locking the male terminal fittings in the respective cavities, a plurality engaging holes formed in the housing at locations spaced from the cavities and spaced from the locks;

a retainer mounted in the receptacle and having portions extending into the front end of the main body for holding the locks of the housing in locked engagement with the respective male terminal fittings;

a sealing plug mounted in the mounting tube and adjacent the rear end of the main body of the housing, the sealing plug being formed with wire insertion holes substantially aligned with the respective cavities, the wire insertion holes being dimensioned for close sealing contact with the wires, pin insertion holes formed in the sealing plug at locations aligned with the engaging holes in the housing; and a plug holder mounted in the mounting tube of the housing and formed with terminal insertion openings substantially aligned with the wire insertion hole, the terminal insertion openings being dimensioned for insertion of the terminal fittings, wherein the plug holder is movable between a partial locking position where the plug holder is spaced from the sealing plug and a full locking position where the plug holder presses the sealing plug, the male terminal fittings being insertable toward the cavities through the terminal insertion openings when the plug holder is at the partial locking position, and engaging pins formed on the plug holder and projecting forwardly toward the housing the engaging pins dimensioned for engaging holes when the plug holder is at the partial locking position.

11. The watertight connector of claim 10, wherein the terminal insertion openings of the plug holder are dimensioned for guiding the terminal fittings into the wire insertion holes of the sealing plug when the plug holder is in the partial locking position.

12. The watertight connector of claim 10, wherein the engaging holes have a round cross-section and extend substantially parallel to a moving direction of the plug holder between the partial locking position and the full locking position.

* * * * *